United States Patent [19]

Walker

[11] 4,333,054

[45] Jun. 1, 1982

[54] APPARATUS FOR USE IN TESTING AN INTERNAL COMBUSTION ENGINE IGNITION SYSTEM

[75] Inventor: Michael J. Walker, Warley, England

[73] Assignee: Lucas Industries Limited, Birmingham, England

[21] Appl. No.: 152,122

[22] Filed: May 21, 1980

[30] Foreign Application Priority Data

May 25, 1979 [GB] United Kingdom ..... 7918386

[51] Int. Cl.[3] ..... F02P 17/00

[52] U.S. Cl. ..... 324/380; 324/385

[58] Field of Search ..... 324/380, 381, 382, 385, 324/388

[56] References Cited

U.S. PATENT DOCUMENTS 3,521,155 7/1970 Zdral ..... 324/380

*Primary Examiner*—Stanley T. Krawczewicz

*Attorney, Agent, or Firm*—Trexler, Bushnell & Wolters, Ltd.

[57] ABSTRACT

An apparatus for testing an i.c.e. ignition system of the kind including an ignition coil and a semi-conductor switch means controlling current interruption in the coil primary, includes a voltage comparator connected to compare the voltage across the switch means with a predetermined voltage. The comparator output starts a monostable timer circuit, the output of which is gated with the output of the comparator to produce an output signal only if the voltage across the switch means falls below the predetermined voltage within a predetermined time duration.

4 Claims, 2 Drawing Figures

APPARATUS FOR USE IN TESTING AN INTERNAL COMBUSTION ENGINE IGNITION SYSTEM

This invention relates to an apparatus for use in testing an internal combustion engine ignition system, particularly a system utilizing an ignition coil and electronic switch means for periodically connecting the primary winding of said ignition coil across a supply and for periodically interrupting the coil primary current.

With such a system it is difficult to establish in a test apparatus whether or not the switch means is operating satisfactorily so as to produce a spark. It is an object of the invention to provide apparatus for testing electronic ignition systems in which this difficulty is overcome.

Apparatus in accordance with the invention comprises a voltage comparator means for connection to the ignition system for detecting the voltage across said switch means and indicating when such voltage is in excess of a predetermined value which is an order of magnitude higher than the system voltage and timing means associated with said comparator means and producing an output indicating a satisfactory interruption of coil current only when the output of the comparator means persists in a state indicating that said voltage has been above said predetermined level for less than a predetermined duration.

Preferably said predetermined level is about 200 V for a 12 V system and said predetermined duration is about 20 μS.

The apparatus preferably also includes a lock-out circuit comprising a further timing means connected to block the input to said first timing means for a second predetermined time (for example about 1 mS) after said first timing means has produced said output.

Figure 1:
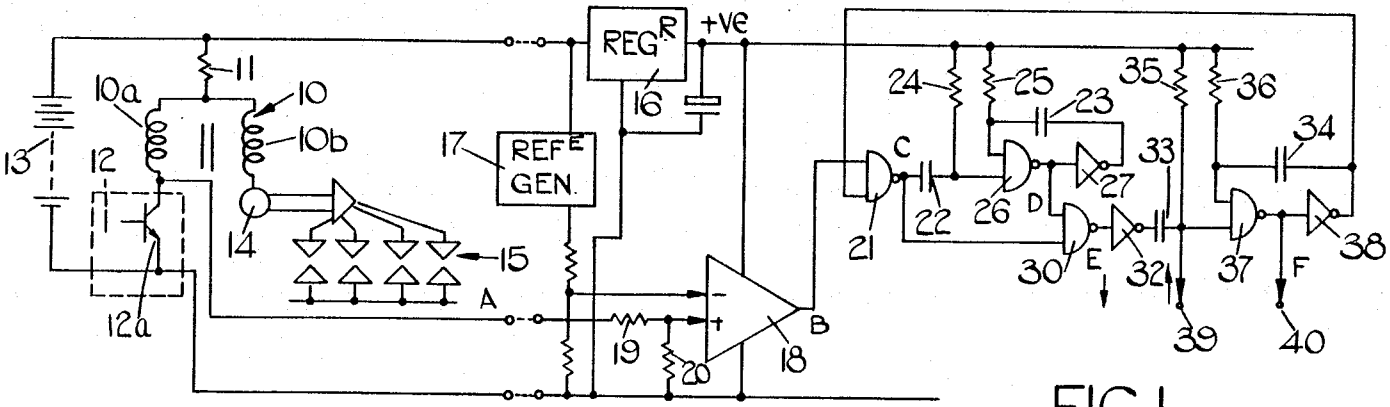
Figure 2:
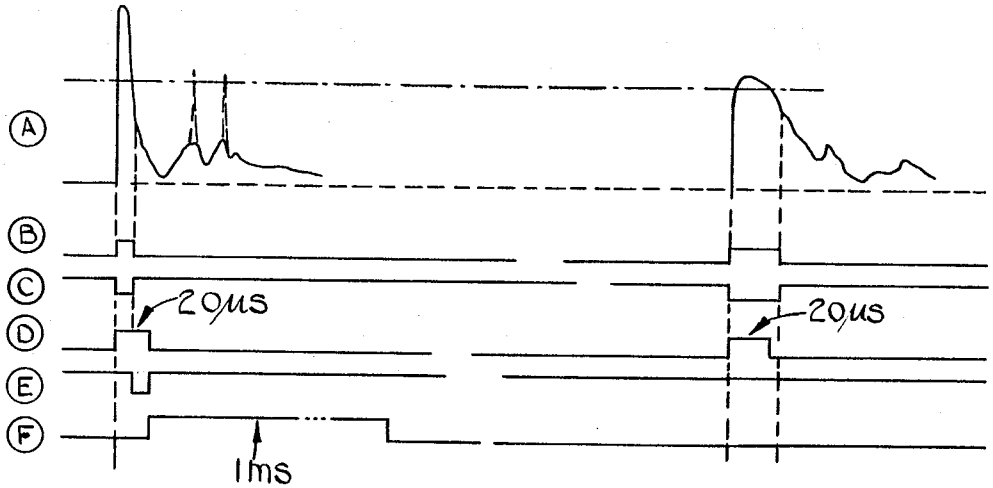

An example of the invention is shown in the accompanying drawings in which FIG. 1 is a schematic circuit diagram of the test apparatus and FIG. 2 is a graphical representation of waveforms at various points in FIG. 1.

The ignition system to be tested is shown at the left-hand end of FIG. 1. The system includes an ignition coil 10 having a primary winding 10*a* and a secondary winding 10*b* joined at one end. This common end of winding 10*a* and 10*b* is connected by a ballast resistor 11 to the positive pole of a battery 13. An electronic switch 12, including an output transistor 12*a* connects the other end of the primary winding 10*a* to earth. The other end of the secondary winding 10*b* is connected via the usual distributor 14 to the spark plugs 15.

The test apparatus derives its power from the battery 13 via a voltage regulator 16. A reference voltage generator 17 is also connected to the battery 13 and provides a reference voltage which is applied to the inverting input of a voltage comparator 18. The non-inverting input of comparator 18 is connected to a point on a voltage dividing network 19, 20 between said other end of the primary winding 10*a* of the coil 10 and earth and chosen so that when the voltage at said other end of the primary winding 10*a* is equal to 200 V the voltages at the inverting and non-inverting inputs of the comparator 18 are equal. Thus the output of comparator 18 is high whenever the voltage at said other end of the primary winding is above 200 V.

The output of the comparator 18 is connected to one input of a NAND gate 21, the output of which is connected to a monostable timer circuit comprising capacitors 22, 23 resistors 24, 25, a NAND gate 26 and an inverter 27. The resistors 24, 25 connect the two inputs of the NAND gate 26 to the +ve rail, capacitor 22 connects the output of NAND gate 21 to one input of NAND gate 26, capacitor 23 connects the output of the inverter 27 to the other input of NAND gate 26 and the output of NAND gate 26 is connected to the input of inverter 27.

The capacitor 22 and the resistor 24 acts to differentiate the output of gate 21 so that this monostable timer circuit is triggered by a negative going change in the output of the NAND gate 21. The capacitor 23 and resistor 25 causes the output of NAND gate 26 to remain high for about 20 μS following triggering.

A further NAND gate 30 has its two inputs connected to the outputs of NAND gates 21 to 26 respectively, so that its output goes low only when both NAND gates 21 and 26 are producing high outputs. An inverter 32 connects the output of gate 30 to the input of a further monostable timer circuit comprising two capacitors 33, 34, two resistors 35, 36 and NAND gate 37 and an inverter 38, arranged to be triggered on by a negative going edge at the output of inverter 32 and to remain on for about 1 mS.

The circuit has two output terminals, namely an output terminal 39 connected via the capacitor 33 to the output of inverter 32, and an output terminal 40 connected to the output of gate 37. The output of inverter 38 is connected to the other input of gate 21.

Trace A in FIG. 2 shows at its left hand end a voltage waveform associated with a satisfactory interruption of coil primary current. It will be noted that the voltage rises very rapidly to a peak well in excess of 200 V, but falls very rapidly (usually about 10 μS later) back below 200 V. The waveform may subsequently include peaks caused by resonance, interference etc which exceed 200 V, but if these occur after 20 μS have elapsed they can be ignored. Trace B shows the output of the comparator 18 and trace C the inverted version of this which appears at the output of gate 21 whenever the output of inverter 38 is high (which is its normal state). Trace D shows the 20 μs pulse generated by the timer 22 to 27 following initial detection of the voltage exceeding 200 V. The output of gate 30 (trace E) goes low only if this 20 μS pulse continues after the output of gate 21 has gone high again indicating that the voltage was above 200 V for less than 20 μS. If the output of gate 30 does go low, the timer 33 to 38 is triggered when this output goes high again, thereby causing the output of inverter 38 to go low for 1 mS and blocking gate 21 for this period.

The right hand end of FIG. 2 shows a situation in which, for various reasons, the voltage remains above 200 V for more than 20 μS, indicating a fault condition (for example electronic switch 12 turning of too slowly)

It will be noted that trace E shows no negative going pulse so that the timer circuit 33 to 38 is not triggered.

The circuit described is used in a test apparatus as disclosed in co-pending U.S. application Ser. No. 151,929 of even date based on U.K. Application No. 7,918,389. The pulses from terminal 39 are combined with pulses from another part of the apparatus indicating that current flow in the resistor 11 has restarted within a set time of the spike detected by the circuit described herein, the combination of this spike with such current restarting indication a satisfactory operation. The pulse produced at each satisfactory operation is passed to a processing circuit including the missing pulse detector of co-pending U.S. application Ser. No. 152,127 of even date based on U.K. Application No. 7,918,385 and the recognition circuit of co-pending U.S. application Ser. No. 152,121 of even date based on U.K. Application No. 7,918,388.

I claim:

1. Apparatus for use in testing an internal combustion engine ignition system of the type utilizing an ignition coil and electronic switch means for periodically connecting the primary winding of the ignition coil across a supply and for periodically interrupting the coil primary current to produce sparks, the apparatus comprising a voltage comparator means for connection to the ignition system for detecting the voltage across said switch means and indicating when such voltage is in excess of a predetermined value which is an order of magnitude higher than the system voltage and timing means associated with said comparator means and producing an output indicating a satisfactory interruption of coil current only when the output of the comparator means persists in a state indicating that said voltage has been above said predetermined level for less than a predetermined duration.

2. Apparatus as claimed in claim 1 in which said predetermined voltage is about 200 V for a 12 V system.

3. Apparatus as claimed in claim 1 or claim 2 in which said predetermined duration is about 20 $\mu$s.

4. Apparatus as claimed in claim 1 further comprising a lock-out circuit comprising further timing means connected to block the input to said first timing means for a second predetermined time duration after said first timing means has produced said output.

* * * * *